US008087671B2

(12) United States Patent
Houlis

(10) Patent No.: US 8,087,671 B2
(45) Date of Patent: Jan. 3, 2012

(54) SPATIAL PUZZLE APPARATUS

(76) Inventor: Pantazis Constantine Houlis, Mount Lawley (AU)

( * ) Notice: Subject to any disclaimer, the term of this patent is extended or adjusted under 35 U.S.C. 154(b) by 101 days.

(21) Appl. No.: 12/315,496

(22) Filed: Dec. 3, 2008

(65) Prior Publication Data

US 2010/0133749 A1 Jun. 3, 2010

(51) Int. Cl.
*A63F 9/08* (2006.01)

(52) U.S. Cl. ..... 273/153 S; 273/156

(58) Field of Classification Search ..... 273/153 R, 273/156, 157 R, 153 S, 153 P, 157 A, 450; 473/594, 595
See application file for complete search history.

(56) References Cited

U.S. PATENT DOCUMENTS

| | | | | | |
|---|---|---|---|---|---|
| 1,471,943 | A | * | 10/1923 | Chambers | 273/157 R |
| 1,518,889 | A | * | 12/1924 | Wooster | 273/153 S |
| 3,845,959 | A | * | 11/1974 | Kosarek | 273/153 S |
| 4,036,503 | A | * | 7/1977 | Golick | 273/153 S |
| 4,424,971 | A | * | 1/1984 | Clark | 273/153 S |
| 4,488,725 | A | | 12/1984 | Clark | |
| 5,090,700 | A | * | 2/1992 | Toukomies | 273/153 S |
| 5,310,183 | A | * | 5/1994 | Glikmann | 273/153 S |
| 5,660,387 | A | * | 8/1997 | Stokes | 273/157 R |
| 5,857,673 | A | * | 1/1999 | Ablonczy et al. | 273/153 S |
| 6,050,566 | A | * | 4/2000 | Shameson | 273/156 |
| 6,116,979 | A | * | 9/2000 | Weber | 446/92 |
| 6,158,740 | A | * | 12/2000 | Hall | 273/156 |
| 6,386,540 | B1 | * | 5/2002 | Stevkovski | 273/153 S |
| 6,513,808 | B2 | * | 2/2003 | Fang | 273/153 S |
| 6,773,011 | B1 | * | 8/2004 | Rom | 273/153 S |
| 2003/0232636 | A1 | | 12/2003 | Ionescu | |

FOREIGN PATENT DOCUMENTS

| | | | |
|---|---|---|---|
| DE | 3027556 | | 6/1981 |
| DE | 4305752 | A1 | 9/1994 |
| EP | 1256364 | A1 | 11/2002 |
| FR | 2797195 | A1 | 2/2001 |
| GB | 2094644 | A | 9/1982 |
| WO | 9417880 | A1 | 8/1994 |

OTHER PUBLICATIONS www.geocities.com/jaapsch/puzzles/clark.
www.geocities.com/jaapsch/puzzles/varikon2.
International Search Report and Written Opinion, PCT/SG2009/000155, dated Aug. 28, 2009.

* cited by examiner

*Primary Examiner* — Steven Wong
(74) *Attorney, Agent, or Firm* — Lerner, David, Littenberg, Krumholz & Mentlik, LLP

(57) ABSTRACT

A spatial puzzle apparatus is disclosed herein. In a preferred embodiment, the apparatus 100 comprises a plurality of puzzle blocks 102 which has a general pyramid shape, and a void 124 which is configured to receive one of the plurality of puzzle blocks 102. A spherical housing 104 is used to house the plurality of puzzle blocks 102 and the void 124. The spherical housing 104 is configured to circumscribe the plurality of puzzle blocks 102 so that the plurality of puzzle blocks 102 and the void 124 define and retain the shape of a cube 106 as the plurality of puzzle blocks 102 are caused to rotate about a common axis to change positions via the void 124 to solve the puzzle. A virtual form of the spatial puzzle apparatus is also disclosed.

18 Claims, 7 Drawing Sheets

SPATIAL PUZZLE APPARATUS

BACKGROUND OF THE INVENTION

This invention relates to a spatial puzzle apparatus.

Puzzles are known for generations and they are popular with adults and kids alike because they stimulate creative thinking and provide an intellectual challenge to the player. Rubik's Cube™ is an example of a successful and popular spatial puzzle.

It is an object of the present invention to provide a spatial puzzle apparatus which provides the public with a useful choice.

SUMMARY OF THE INVENTION

In a first aspect of the invention, there is provided a spatial puzzle apparatus comprising: a plurality of puzzle blocks and a void which is configured to receive one of the plurality of puzzle blocks; a housing arranged to enclose the plurality of puzzle blocks and the void, the housing being configured to circumscribe the plurality of puzzle blocks so that the plurality of puzzle blocks define and retain a predetermined shape as the plurality of puzzle blocks are caused to rotate about a common axis to change positions via the void.

To play the puzzle, a user holds the spatial puzzle apparatus in his hand and manipulates the puzzle apparatus, for example by directional shaking, to cause the puzzle blocks to change positions making use of the void. With this arrangement, a simple and yet challenging puzzle is created. Through playing the puzzle, a player can explore the relationship between three-dimensional space and two-dimensional planar structures, the interrelation of inner and outer space characteristics, their specific features and regularities. Such a puzzle also has considerably wide range of choices between possible step variations so that the player can entertain himself while the puzzle maintains his attention and improves his mechanical aptitude simultaneously. The players' hand and eye coordination skills can be improved and supports kinaesthetic learning process. As a result, such a puzzle is not only educational but also fun.

It can also be appreciated that in the course of playing, the solution of the puzzle is altered by rearranging, through any sequence of steps, the puzzle blocks within the spherical housing. Following this, the goal of the game may lie in arriving at the initial regular specific pattern of the puzzle blocks, possibly and preferably within the shortest period of time, i.e. by performing, out of a large number of variations, the shortest sequence of steps through which all puzzle blocks are moved back into their initial position. Arriving at a predetermined specific pattern of the puzzle blocks may prove to be a hard task despite the fact that handling the puzzle seems, at least at first instance, to be very easy, resulting in a challenging puzzle.

While handling the puzzle apparatus with an aim of solving the puzzle, the player is confronted with questions regarding the relationship between a three-dimensional space and planer structures contained and moved therein. Problems of interrelating the senses of rotation, the reversibility of coordinate systems, and the terms of "outside" and "inside" will gradually become more and more apparent to regular and enthusiastic users of the puzzle.

Preferably, the plurality of puzzle blocks comprises pyramid-shaped puzzle blocks with the apex of each pyramid-shaped puzzle block configured to meet at the common axis. The pyramid-shaped puzzle blocks may be substantially identical and each of the pyramid-shaped puzzle blocks may have a regular polygon base. Preferably, the puzzle blocks rotate and slide at the same time to change positions.

In the alternative, the pyramid-shaped puzzle blocks may comprise two different types and may comprise two different polygon-shaped bases.

Preferably, each puzzle block comprises a base that carries a visual representation, such that when the puzzle blocks are properly arranged, the combination of the visual representations of each of the bases provides a distinct representation which represents a solution to the puzzle. The visual representation carried by each base may be identical. The visual representation may comprise colours or a combination of different colours to form a pattern. It is also envisaged that the visual representation may comprise characters.

The plurality of puzzle blocks may be made of the same or different types of material, such as word, clear plastic or ferromagnetic material. Inside of the entire piece being made of ferromagnetic material, it is envisaged that at least one side of the plurality of puzzle blocks may comprise a ferromagnetic material layer. The ferromagnetic layer thus enables a user to use magnetic force to manipulate/rotate the puzzle blocks.

The housing may comprise a finger hole to allow a user's finger to rotate the puzzle blocks using a finger. The housing may be hermetically sealed, and may comprise a retaining mechanism arranged to releasably hold the position of one of the plurality of puzzle blocks.

Preferably, the housing has a sphere shape.

The plurality of puzzle blocks may be arranged to define the general shape of a Platonic or Archimedean solid. It is preferred to arrange the plurality of puzzle blocks such that they are arranged to rotate about a common point to change positions.

The plurality of puzzle blocks may be edible, and may be made of chocolate.

It is also envisaged that the spatial puzzle apparatus may be implemented virtually or electronically such as for an electronic game, and this forms a second aspect of the invention which provides a virtual spatial puzzle apparatus comprising: a plurality of virtual puzzle blocks and a virtual void which is configured to receive one of the plurality of virtual puzzle blocks; a virtual housing arranged to enclose the plurality of virtual puzzle blocks and the virtual void, the virtual housing being configured to circumscribe the plurality of virtual puzzle blocks so that the plurality of virtual puzzle blocks define and retain a predetermined shape as the plurality of virtual puzzle blocks are caused to rotate about a common virtual axis to change positions via the virtual void.

The virtual puzzle apparatus may be implemented on an interactive electronic game which may include a finger or hand controller to control the movement of the virtual housing, thereby causing the virtual puzzle blocks to rotate about the common axis. The interactive electronic game may be implemented online and may be also programmed as a multiplayer game so that players compete against one another to solve the puzzle within the shortest period of time.

BRIEF DESCRIPTION OF THE DRAWINGS

An embodiment of the invention will now be described, by way of example, with reference to the accompanying drawings in which.

DETAILED DESCRIPTION OF THE PREFERRED EMBODIMENT

Figure 1A:
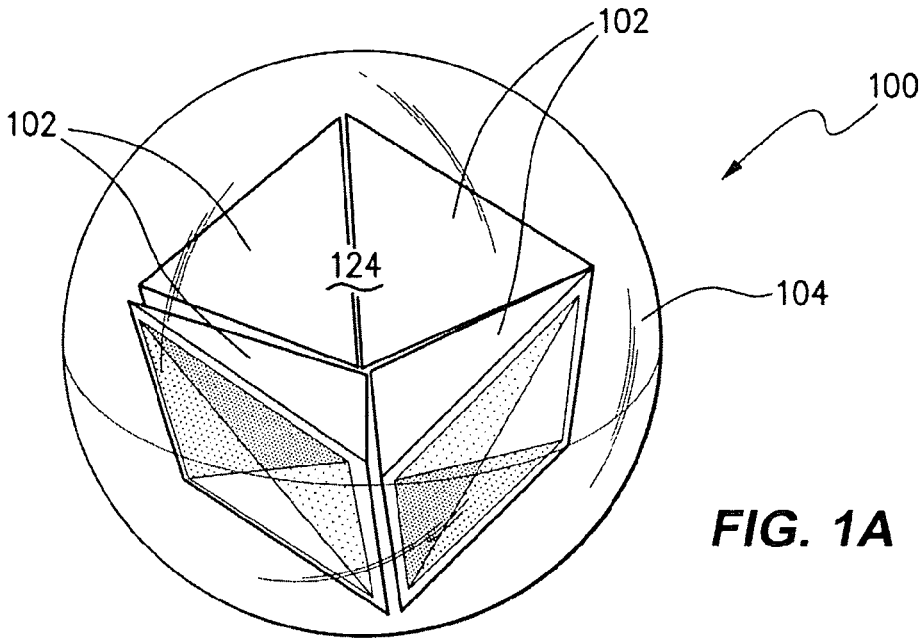
FIG. 1A is a pictorial representation of a spatial puzzle apparatus comprising a plurality of puzzle blocks according to a preferred embodiment of the present invention.
Figure 1B:
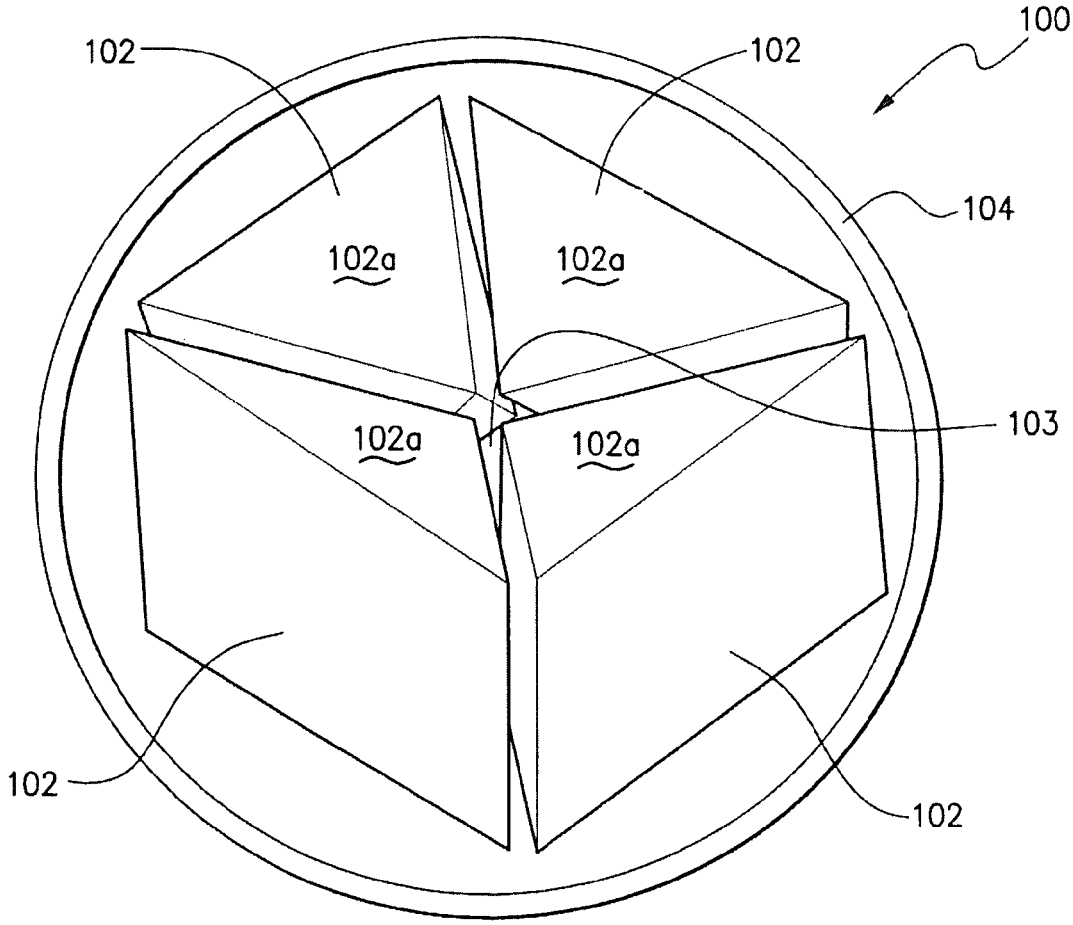
FIG. 1B is an enlarged schematic two-dimensional view of the spatial puzzle apparatus of FIG. 1A.

FIG. 1 is a pictorial representation of a spatial puzzle apparatus 100 according to a preferred embodiment of this invention. The spatial puzzle apparatus 100 comprises a plurality of puzzle blocks 102 housed within a spherical housing 104 which defines a game space for the puzzle blocks to move. Each of the puzzle blocks 102 is made of light plastic and is of a pyramid shape as will be further explained below. The spherical housing 104 is made of clear plastics and comprises two equal hemispheric portions sealed hermetically together, so that dusts and dirt, etc. from the outside is prevented from access to the game space. FIG. 1B shows the positional relationships between the puzzle blocks 102 more clearly.

Figure 2:
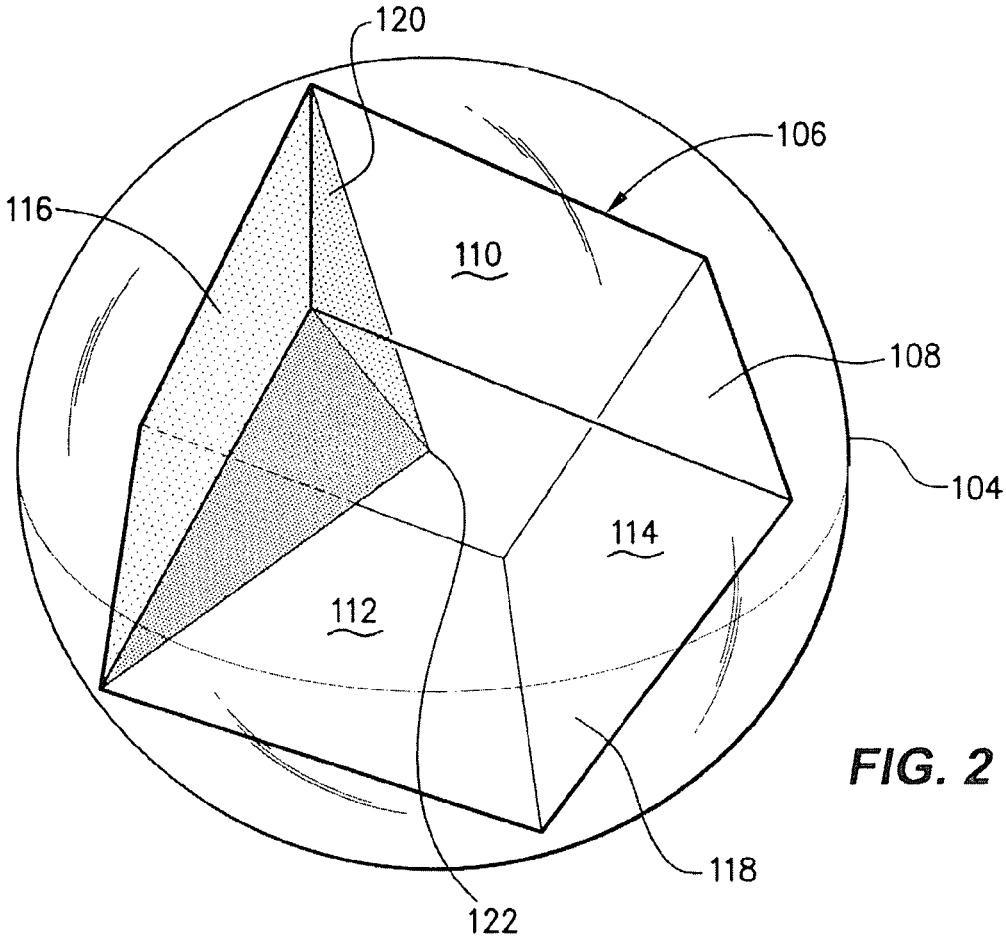
FIG. 2 is a schematic view of a hexahedron which is a Platonic solid on which the spatial puzzle apparatus of FIG. 1 is based upon.
Figure 3:
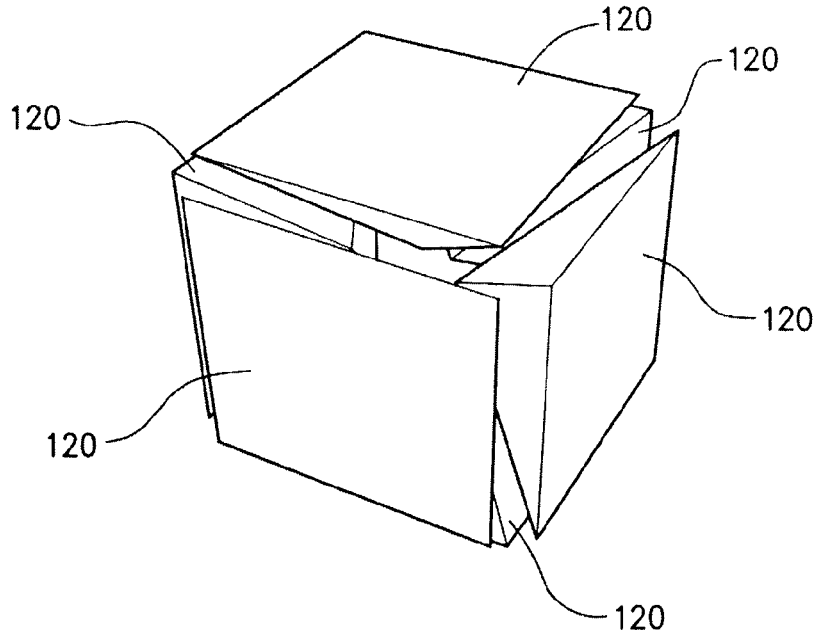
FIG. 3 illustrates how the hexahedron of FIG. 2 is subdivided into six identical pyramids.

The concept of the spatial puzzle apparatus 100 of this embodiment is based on a hexahedron 106 which is one of the Platonic solids, and the hexahedron 106 is commonly called a cube. As shown in FIG. 1B, the cube 106 has six square bases 108, 110, 112, 114, 116, 118 and therefore, the cube 106 is formed by six identical pyramids 120 as shown in FIG. 3. FIG. 2 shows how one of the pyramids 120 looks like more clearly. The arrangement of each of the six pyramid's apex 122 meets at a common axis 103 about the centre of the spherical housing 104 (shown in 2-dimensions in FIG. 1B). The spatial puzzle apparatus 100 is formed by removing one pyramid from the six pyramids to create a void 124 (see FIG. 1) which enables one of the pyramids to rotate into the void 124 thereby creating a further void (left by the pyramid that moved into the void 124) for another pyramid. In other words, the remaining five pyramids 120 form the puzzle blocks 102 of the spatial puzzle apparatus 100, as shown in FIG. 1.

The spherical housing 104 is arranged to circumscribe the puzzle blocks 102 so that the vertices of the puzzle blocks are releasably engaged with the interior of the spherical housing 104 so as to retain the shape of the Platonic solid, in this case the general shape of a cube 106, but still allowing the puzzle blocks 102 to move freely within the spherical housing 104, albeit with certain movement of the spherical housing 104. It should be mentioned that depending on the arrangement of the spherical housing 104 and the puzzle blocks 102, the puzzle blocks 102 may be arranged to just rotate or rotate and slide to change positions.

Each of the square bases 108, 110, 112, 114, 116, of the puzzle blocks 102 are provided with distinct visual representations which provide a visual indicator of the progress of the player's effort to solve puzzle. The distinct visual representation may be symbols, colour combinations, graphic pictures which, when the game pieces are arranged properly, show a specific, pre-determined characteristic pattern. To assist with the explanation of how the spatial puzzle apparatus works and for ease of explanation, each of the five square bases 108, 110, 112, 114, 116 of the puzzle blocks 102 are shown in two-dimensions in FIG. 4. Each square base 108, 110, 112, 114, 116 is divided into four equal portions 108*a*, 108*b*, 108*c*, 108*d* (using the square base 108 as an example) with the letters A, B, C and D respectively. For a greater aesthetic appeal, these four equal portions may contain different color combinations.

Figure 4:
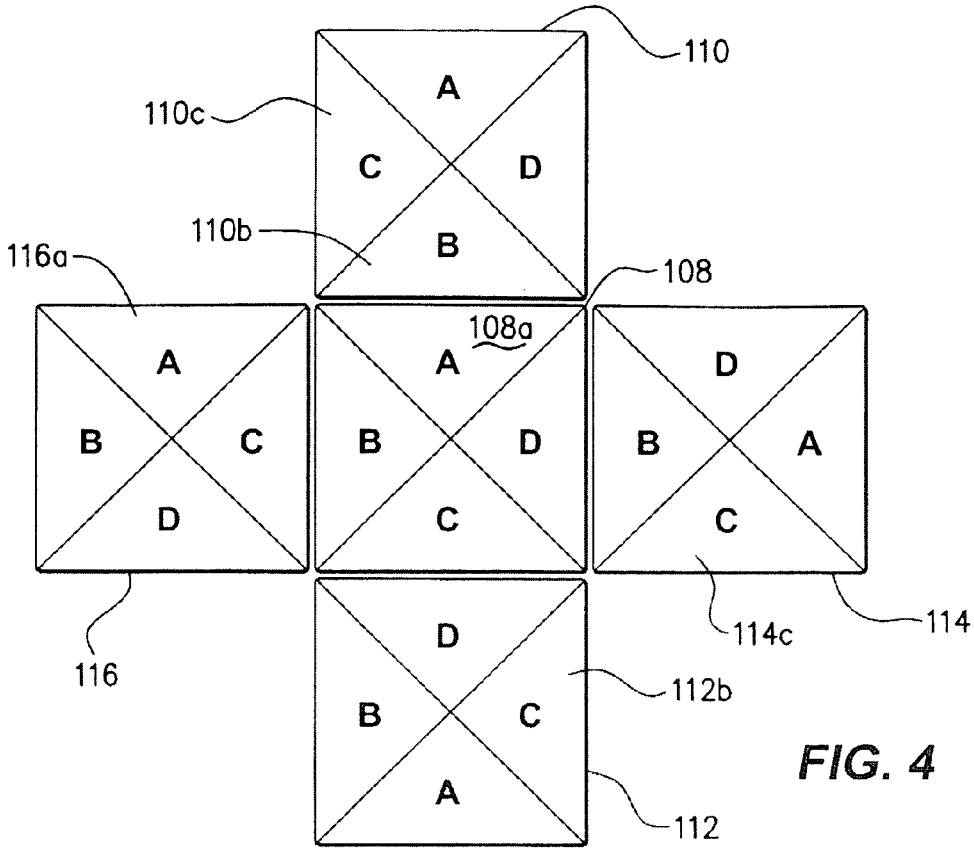
FIG. 4 is an example of visual representations of the base of the plurality of puzzle blocks of FIG. 1 when shown in 2-dimensions.

The rest of the square bases 110, 112, 114, 116 are similarly divided as shown in FIG. 4.

As it can be appreciated, in FIG. 4, the portion 108*a* bearing the letter A is aligned with the portion 110*b* bearing the letter B of the adjacent puzzle block 110. The portion 110*c* bearing the letter C is immediately adjacent to portion 116*a* bearing the letter A of the adjacent block 116 (when arranged in three dimensional as shown in FIG. 1). Likewise, the portion 114*c* bearing the letter C of puzzle block 114 is adjacent to portion 112*b* bearing the letter B of puzzle block 112.

Figure 5:
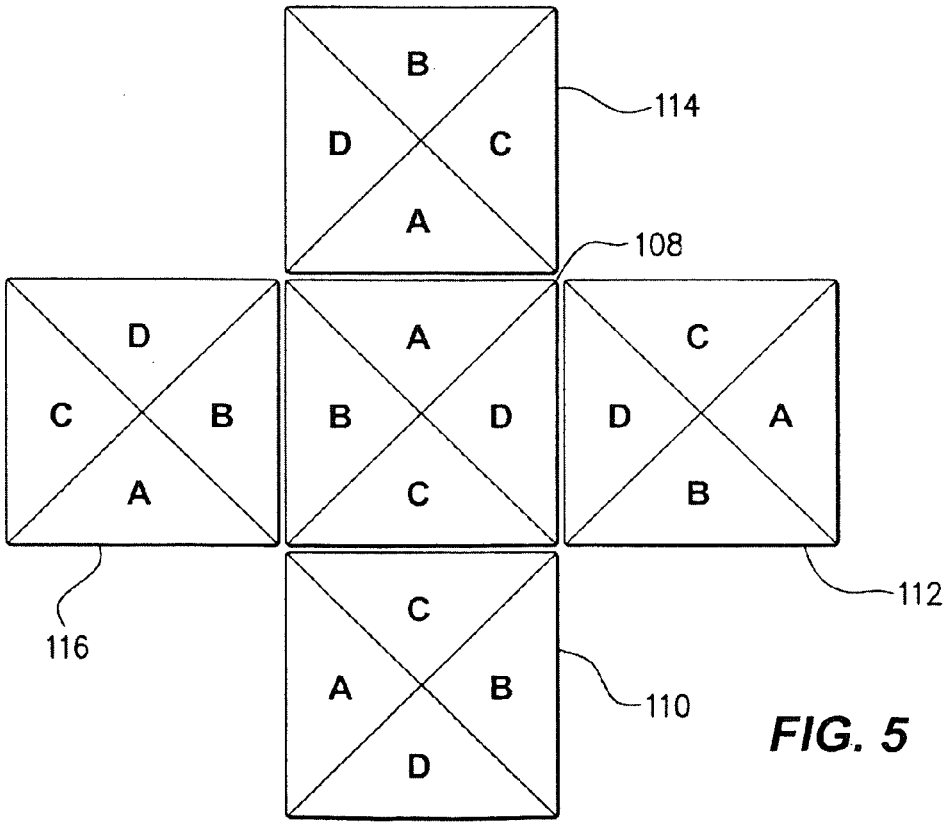
FIG. 5 illustrates the visual representations of FIG. 4 when the plurality of puzzle blocks are re-arranged to solve the puzzle.

An object of the puzzle is to rearrange the puzzle blocks 102 so that the adjacent portions of each block have the same letter, as shown in FIG. 5. This means that starting from the puzzle positions that provide the visual representations of FIG. 4, a player needs to hold the spatial puzzle apparatus 100 in a hand, and tilt, shake or rotate the spatial puzzle apparatus 100 to urge a desired puzzle block 102 to move about 90° or rotate about the common axis 103 into the void 124. This thus crates a further void left by the puzzle block 102 that moved into the void 124 and allows another puzzle block to move there. The player thus manipulates the puzzle apparatus 100 in order to shift or rearrange the positions of the puzzle blocks 102 one at a time making use of the empty space defined by the void and the player solves the puzzle when the arrangement of the puzzle blocks 102 provides the visual representation shown in FIG. 5 (i.e. when the letters on adjacent portions are the same, although the direction of the letters have been re-arranged for easy reading and may not be what is actually the case if the puzzle is solved by playing the spatial puzzle apparatus 100).

The possible movements of the puzzle blocks 102 are determined by general rules of space geometry defined by the space within the spherical housing 104 and the puzzle blocks 102, and by the specific geometric dimension of the spherical housing 104.

During the movement, it can be appreciated that the spherical housing 104 enables the puzzle blocks 102 to retain the general shape of the cube 106. As it can be appreciated, all five pyramid-like puzzle blocks 102 may change and rotate to create a challenging puzzle which requires a sequential solution.

As it can be appreciated from the above, removing a pyramid to create a void from a Platonic solid (in this case a cube) provides sufficient space to enable another puzzle block to move into the void by shaking the puzzle apparatus 100. The spherical housing 104 functions as a circumscribed sphere or circumsphere which is arranged to retain the general shape of the cubic shape and yet allowing movement of the puzzle blocks into the void.

The temporary positional relationship between one of the puzzle blocks 102 and the spherical housing 104 to which the puzzle block may be overcome by exercising directional dynamic impacts to the puzzle block, for example, by shaking the spatial puzzle apparatus 100 in a particular direction with a certain skill that can be learned by experience and frequent playing of the puzzle apparatus 100. By such dynamic impacts of proper force and direction, the puzzle block is forced to separate from the respective lateral face of the spherical housing 104 simply under its own weight and inertia.

The spherical housing 104 improves the handling characteristics of the puzzle apparatus 100. Such a shape, besides being more suitable for manual handling, is less dangerous to children. Furthermore, the spherical shape, may improve the freedom of movement of the pyramid puzzle blocks in the game space defined by the interior of the spherical housing 104.

The described embodiment should not be construed as limitative. For examples, the described embodiment uses a cube as a Platonic solid but other Platonic solids may be used such as Tetrahedron, Octahedron, Dodecahedron, and Icosahedron.

Figure 6:
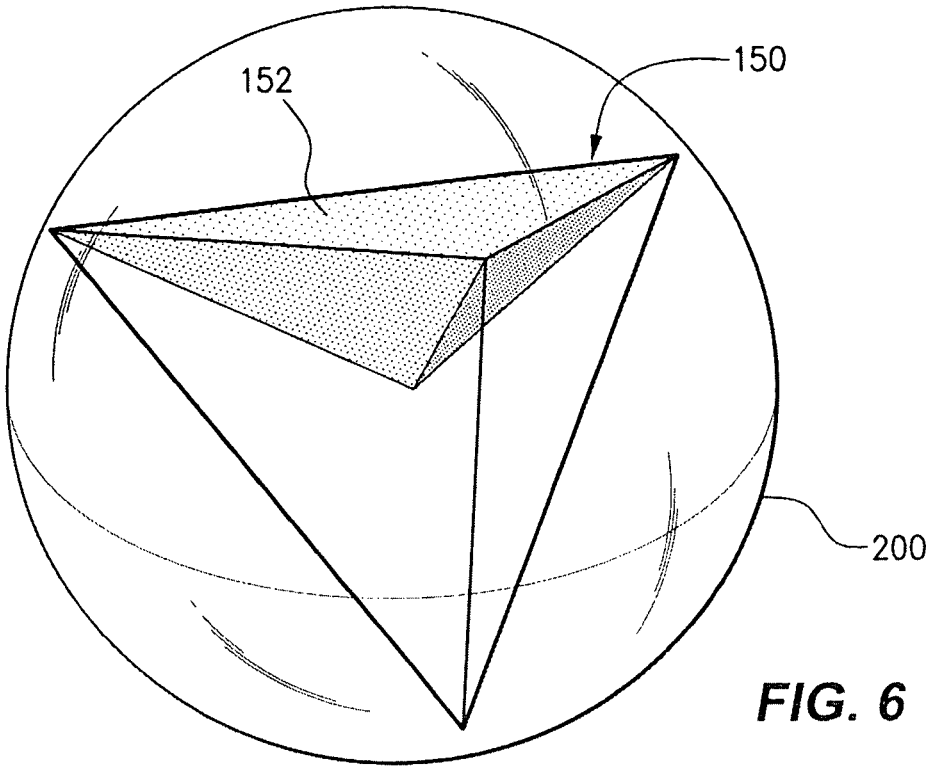
FIG. 6 is a schematic view of a tetrahedron which is another example of a Platonic solid.

(a) A Tetrahedron 150 has four triangular sides as shown in FIG. 6. Therefore, it may be divided into four identical pyramids (one of which 152 is shown in FIG. 6), such that, each pyramid has a triangular base.

Figure 7:
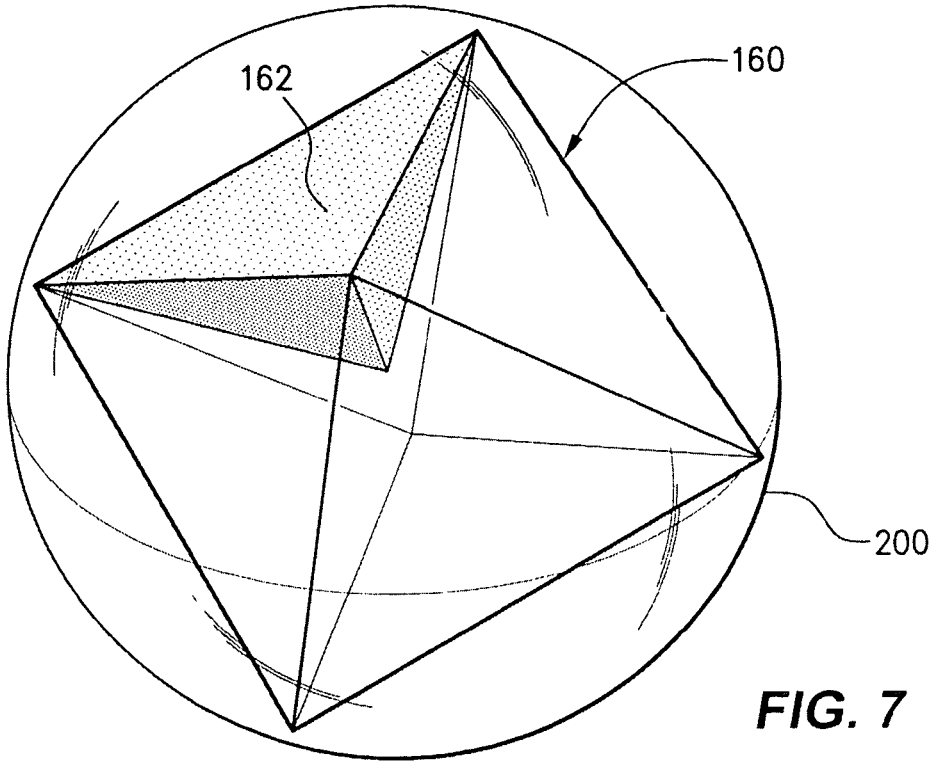
FIG. 7 is a schematic view of an octahedron which is another example of a Platonic solid.

(b) An Octahedron 160 has eight triangular sides as shown in FIG. 7. Therefore, it may be divided into eight identical pyramids (one of which 162 is shown in FIG. 7), such that, each pyramid has a triangular base.

Figure 8:
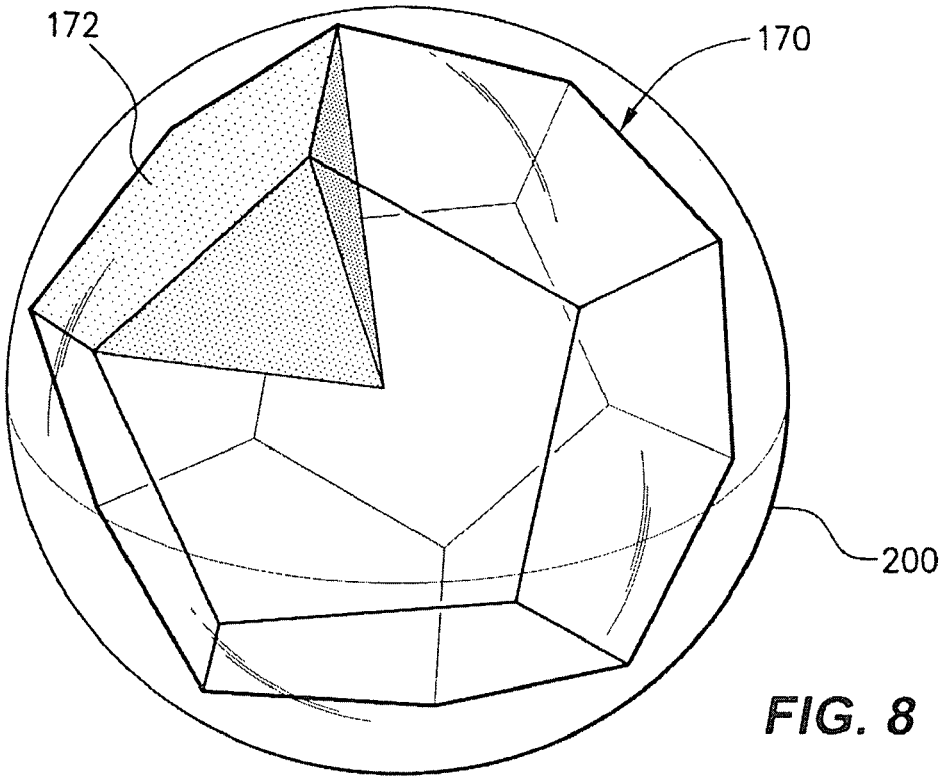
FIG. 8 is a schematic view of a dodecahedron which is another example of a Platonic solid.

(d) A Dodecahedron 170 has twelve pentagonal sides as shown in FIG. 8. Therefore, it may be divided into twelve identical pyramids (one of which 172 is shown in FIG. 8), such that, each pyramid has a pentagonal base.

Figure 9:
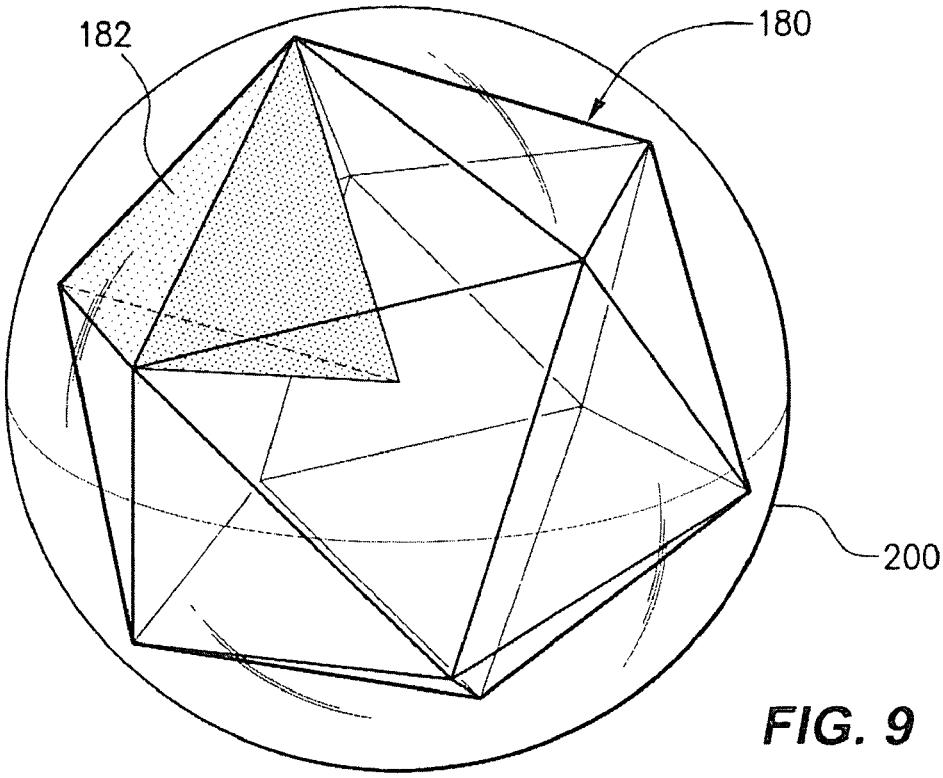
FIG. 9 is a schematic view of an icosahedron which is another example of a Platonic solid.

(e) An Icosahedron 180 has twenty triangular sides as shown in FIG. 9. Therefore, it may be divided into twenty identical pyramids (one of which 182 is shown in FIG. 9), such that, each pyramid has a triangular base.

Similar to a cube, one of the pyramids in each of these Platonic solids may be removed to create a spatial puzzle. Indeed, more pyramids may be removed for the more complex Platonic solids such as a Dodecahedron and Icosahedron. Indeed, for a spatial puzzle that is based on the Dodecahedron, it is preferred to remove two pyramids forming the Dodecahedron shape to facilitate movement of the puzzle blocks, although the puzzle would still work with one pyramid removed and the puzzle blocks are loosely circumscribed to the housing.

Note that in all cases, the peak of all pyramids is around the centre of each Platonic solid so that the pyramids rotate and slide about this centre. This point is also the centre of the corresponding circumscribed spherical housing 200 (shown in 2-dimensions in FIGS. 6 to 9) which retains the general shape of the Platonic solids as the pyramids are urged to move around the housing to solve the puzzle. Similarly, the base of each Platonic solid bears distinct visual representations that are used as an indication to solve the puzzle.

The angle of movement or rotation of a puzzle block to take up the position of a void may differ for different Platonic geometric solids, as can be appreciated from the above.

In the described embodiment of the cube, letters are used for simplicity but the surfaces of the polygon-shaped pyramids of the puzzle blocks may be marked with aesthetically more appealing representations, for example, symbols, sections or parts of graphic pictures which, when the game pieces are arranged properly, show a specific, pre-determined characteristic pattern. One such specific pattern could be seen, for example, in one particular arrangement on the resulting outer surfaces of the five puzzle blocks, and in another particular arrangement on the resulting inner surfaces 102*a* of puzzle blocks (see FIG. 1B). To solve such a puzzle, the user may need to rely on his memory to solve the puzzle. This is because when the user causes a puzzle block 102 to rotate to fill up the void 124, the inner surface 102*a* of this block 102 becomes hidden from view and thus, the user may need to rely on memory in order to know which other puzzle blocks 102 to move to solve the puzzle as determined by a predetermined pattern on the inner surfaces 102*a*.

Further, in the described embodiment, the spherical housing 104 is arranged to enclose the puzzle blocks and the movement or rotation of puzzle blocks in the game space is created by directional shaking, for example, aided by gravity. However, it is envisaged that magnetic force may be used and in this case, the puzzle blocks 102 are preferably made of ferromagnetic material. As an alternative, the puzzle block may be made of insulative material but at least one side of the puzzle block comprises a layer of ferromagnetic material (for example, attached using adhesive). This type of puzzle that uses magnetic force thus provides another form of challenge to users.

Instead of light plastic, each puzzle block 102 may be made of wood. Each puzzle block may also be hollow or without a base (for example, when the puzzle uses the inner surfaces 102*a* as a guide to solve the puzzle as explained above instead of the base). The corners of each puzzle block 102 may also be rounded or truncated to apply less pressure/force to the inner walls of the spherical housing 104. Further, weights may be added to the bases 108, 110, 112, 114, 116, 118 to create more robust movement of the puzzle blocks 102.

It is also envisaged that each puzzle block may be made of something edible such as chocolate, cheese, biscuits or some type of sweet. The puzzle may thus be marketed as a "puzzle-snack", perhaps encouraging the user to solve the puzzle before consuming the snack. Of course, this would mean that the housing 104 may be opened by the user.

Also, instead of hermetically sealing the spherical housing, a finger hole may be formed on the spherical housing to allow finger-tip handling of the puzzle blocks. Instead, or in addition, retaining means in the form of at least one surface area of increased mechanical friction or adherence may be used.

A further variation for handling the puzzle apparatus 100 may involve each of the surfaces of the puzzle blocks to be provided with actuating means for releasing the gripping force by which a puzzle block 102 is temporarily and releasably held to the spherical housing. In an example, the spherical housing may be provided with actuating means such as a sensor or push button for indirect holding of the game pieces of the puzzle. This is preferred over the earlier variation of having a finger hole since the spherical housing 104 may still be sealed hermetically, so that dust and dirt, etc. from the outside is prevented from entering the game space. All kinds of such actuating means for indirect handling perform, independently from their actual design, the act of pushing away the puzzle block from the lateral face to which it is held by a certain predetermined initial distance, whereby the gripping force maintained by magnetic pull or friction, for example, is ceased, and free movement of the game piece concerned is allowed.

In certain embodiments of the invention, the retaining means may simultaneously serve as a symbol, i.e., as means of making the puzzle blocks, for example, by coloring or otherwise, so that they will become distinguishable from each other. When designed so, the function of retaining is, at least to a certain extent, substantially hidden or even disguised, so that such embodiments of the invention are made even more "puzzling".

Figure 10:
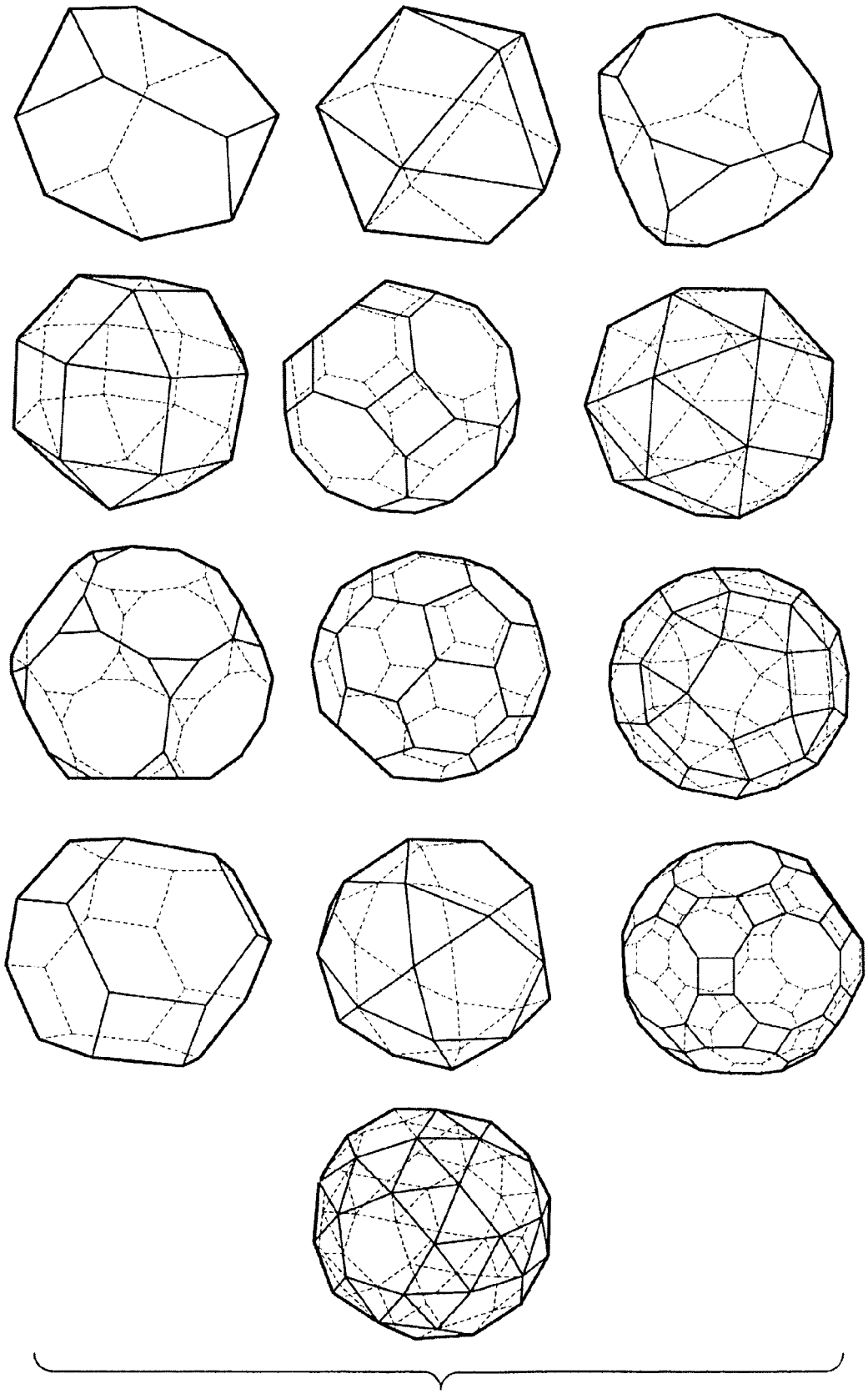
FIG. 10 are examples of Archimedean solids that may be used as basis to create further spatial puzzle apparatus.

In the described embodiment, Platonic solids are used as examples and thus, it is preferred to use a spherical housing 104 to define the game space and to create the circumsphere. However, it is envisaged that the present invention may be extended to other solids such as Archimedean solids as shown in FIG. 10. FIG. 10 shows (from top row left to right followed by second row) truncated tetrahedron, cuboctahedron, truncated hexahedron, truncated octahedron, Rhombi cub octahedron, truncated cuboctahedron. snub hexahedron, icosidodecahedron, truncated dodecahedron, Truncated icosahedron, rhombicosidodecahedron, truncated icosidodecahedron, snub dodecahedron. Similarly to the Platonic solids', each of those solids are divided into at least two and at most three types of pyramids (since they have two or more types of polygons meeting in identical vertices), to be circumscribed inside a spherical housing. For example, a truncated tetrahedron may comprise four triangular base pyramids and four hexagonal base pyramids.

The housing in the described embodiment and for Platonic solids is a spherical shape. However, other shapes of housing are envisaged that can retain the configuration of the Platonic solid. Also, in the described embodiment, the spherical housing 104 comprises two hemispheric portions and sealed hermetically together but this may not be so. Both hemispheric portions may be detachable from each other.

Figure 11:
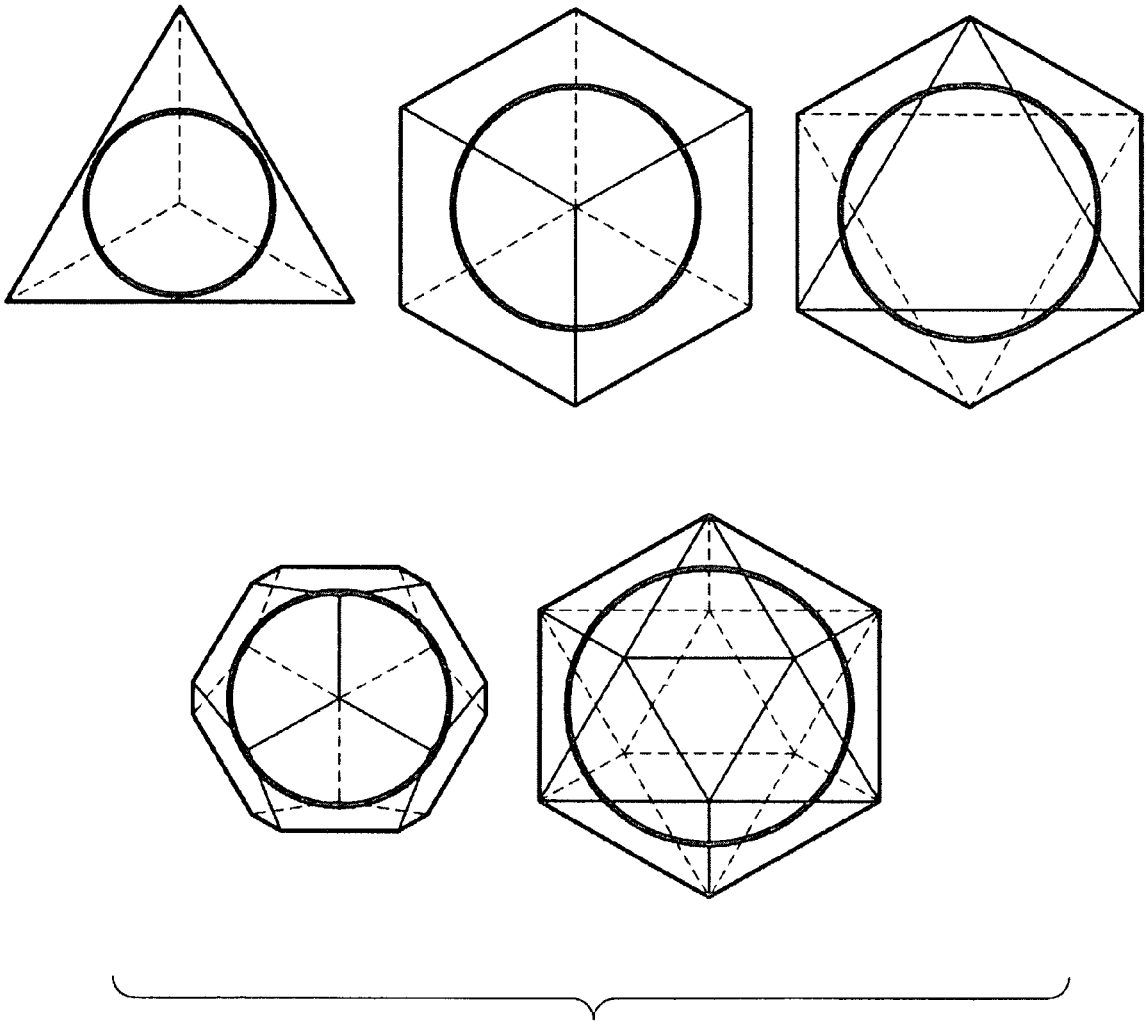
FIG. 11 are examples of "inspheres".

For example, the same concept may be used with inspheres, where the pyramids have a "pillowed" shape. To illustrate what this means, in the preferred embodiment, the puzzle apparatus 100 is based on a cube. For "inspheres", this is similar but with the base of the pyramid shaped puzzle blocks slightly "exploded" in a spherical way so that the general shape of the puzzle blocks looks like a sphere, as shown in FIG. 11. The housing for "inspheres" is preferably a 'cube", although it is still possible to use a spherical housing.

The same concept may be used with any other shapes (including the above two cases) which fall into the same type of topological transformation, including bandaging of pieces, stellation of pieces, and truncation of pieces, provided that the concept of mechanism is preserved, main concept of mechanism being that the peaks of all pyramids meet at the centre of the complete structure and 3D sliding movement is allowed.

The spatial puzzle apparatus may be used for educational, civil, engineering, aviation, automobile and entertainment purposes. The spatial puzzle apparatus may also be adapted as part of a smart lock in a security system.

In this respect, it is also envisaged that the spatial puzzle apparatus may be implemented virtually or electronically such as for an interactive electronic game. An example would be to offer the spatial puzzle apparatus in virtual form as a 3-D representation on the internet so that a player can use some form of controller, such as a mouse or joystick to manipulate or control the movement of the virtual housing so as to rotate the virtual puzzle blocks. The puzzle may also be implemented as a multi-player game where two or more players compete with each other to solve the puzzle within the shortest period of time.

Further, with touch-screen technology becoming more widespread, it is also envisaged that a player may control the movement of the virtual housing by touching the screen of a mobile gaming device programmed with the virtual spatial puzzle apparatus. The mobile gaming device may be a mobile phone, PDA or any handheld gaming device.

Having now fully described the invention, it should be apparent to one of ordinary skill in the art that many modifications can be made hereto without departing from the scope as claimed.

The invention claimed is:

1. A spatial puzzle apparatus comprising:

a plurality of pyramid-shaped puzzle blocks and a void which is configured to receive one of the plurality of pyramid-shaped puzzle blocks; and a housing having a central rotation point and arranged to enclose the plurality of puzzle blocks and the void, each of the pyramid-shaped puzzle blocks having an apex arranged to meet at the central rotation point of the housing, the central rotation point being common to each of the plurality of pyramid-shaped puzzle blocks, wherein the housing is configured to circumscribe the plurality of pyramid-shaped puzzle blocks so that the plurality of pyramid-shaped puzzle blocks define and retain a predetermined shape as at least some of the plurality of pyramid-shaped puzzle blocks are caused to rotate freely about the central rotation point of the housing to change positions via the void.

2. A spatial puzzle apparatus according to claim 1, wherein the pyramid-shaped puzzle blocks are substantially identical.

3. A spatial puzzle apparatus according to claim 2, wherein each of the pyramid-shaped puzzle blocks have a regular polygon base.

4. A spatial puzzle apparatus according to claim 1, wherein each of the pyramid-shaped puzzle blocks comprises a base that carries a visual representation, such that when the pyramid-shaped puzzle blocks are properly arranged, the combination of the visual representations of each of the bases provides a distinct representation which represents a solution to the puzzle.

5. A spatial puzzle apparatus according to claim 4, wherein the visual representation carried by each of the bases is identical.

6. A spatial puzzle apparatus according to claim 4, wherein the visual representation comprises colours.

7. A spatial puzzle apparatus according to claim 4, wherein the visual representation comprises characters.

8. A spatial puzzle apparatus according to claim 1, wherein the plurality of pyramid-shaped puzzle blocks are made of ferromagnetic material.

9. A spatial puzzle apparatus according to claim 1, wherein at least one side of the plurality of pyramid-shaped puzzle blocks comprises a ferromagnetic material layer.

10. A spatial puzzle apparatus according to claim 1, wherein the housing comprises a finger hole.

11. A spatial puzzle apparatus according to claim 1, wherein the housing is hermetically sealed.

12. A spatial puzzle apparatus according to claim 1, wherein the housing has a sphere shape.

13. A spatial puzzle apparatus according to claim 1, further comprising a retaining mechanism arranged to releasably hold the position of one of the plurality of pyramid-shaped puzzle blocks.

14. A spatial puzzle apparatus according to claim 1, wherein the plurality of pyramid-shaped puzzle blocks are arranged to define the general shape of a Platonic or Archimedean solid.

15. A spatial puzzle apparatus according to claim 1, wherein the plurality of pyramid-shaped puzzle blocks are edible.

16. A spatial puzzle apparatus according to claim 1, wherein the plurality of pyramid-shaped puzzle blocks are made of chocolate.

17. A spatial puzzle apparatus according to claim 1 wherein the pyramid shaped puzzle blocks comprise two different types.

18. A spatial puzzle apparatus according to claim 17 wherein the two different types of pyramid puzzle blocks comprise two different polygon shaped bases.

* * * * *